US005289668A

United States Patent [19]

Meyer

[11] Patent Number: 5,289,668

[45] Date of Patent: Mar. 1, 1994

[54] EDGE PROTECTOR DELIVERY AND POSITIONING APPARATUS AND METHOD

[76] Inventor: Brian T. Meyer, 13735 S. Lavergne, Crestwood, Ill. 60445

[21] Appl. No.: 988,735

[22] Filed: Dec. 10, 1992

[51] Int. Cl.[5] ..... B65B 61/22

[52] U.S. Cl. ..... 53/410; 53/139.7

[58] Field of Search ..... 53/587, 588, 589, 139.6, 53/139.7, 580, 582, 399, 410, 176

[56] References Cited

U.S. PATENT DOCUMENTS

| | | | |
|---|---|---|---|
| 3,095,678 | 7/1963 | Cliff et al. | 53/139.7 X |
| 3,169,471 | 2/1965 | McLean | 53/139.7 X |
| 3,241,287 | 3/1966 | Chundelak | 53/139.7 X |
| 3,271,925 | 9/1966 | Aubery | 53/139.6 |
| 3,378,987 | 4/1968 | Lems | 53/139.7 X |
| 3,398,675 | 8/1968 | Potter et al. | 53/529 X |
| 3,585,780 | 6/1971 | Elmore | 53/139.7 X |
| 3,995,409 | 12/1976 | Discavage et al. | 53/139.6 |
| 4,587,791 | 5/1986 | Brouse et al. | 53/139.6 |
| 4,700,530 | 10/1987 | Norberg | 53/139.7 X |

FOREIGN PATENT DOCUMENTS

| | | | |
|---|---|---|---|
| 2431153 | 1/1976 | Fed. Rep. of Germany | 53/139.7 |
| 0049195 | 4/1977 | Japan | 53/139.7 |
| 0070693 | 6/1977 | Japan | 53/139.7 |

*Primary Examiner*—Horace M. Culver
*Assistant Examiner*—Daniel Moon
*Attorney, Agent, or Firm*—Kinzer, Plyer, Dorn McEachran & Jambor

[57] ABSTRACT

A positioning apparatus for positioning and retaining an edge protector at an edge of a package to be looped with a strapping comprising an edge protector magazine for retaining stacked, nested edge protectors including a magazine delivery station for systematically dispensing individual edge protectors to be dispensed, a saddle shuttle assembly for transporting each individual edge protector from the magazine delivery station to the edge of the package, the saddle shuttle assembly including at least one forwardly extending clip orienting and retaining each individual edge protector on the saddle shuttle assembly while it is being transported to the package edge, a pusher for selectively driving an edge protector from the magazine delivery station onto the saddle shuttle assembly, the pusher including a pushing surface normal to the longitudinal axis of the edge protector and a device to reciprocate the pusher between the magazine delivery station and the saddle shuttle assembly and a retainer bar for applying a substantially normal force to a package non-contacting surface of the edge protector, the retainer bar retaining the edge protector immediately adjacent the package edge and an edge protector package contacting surface in conforming relation to the edge while the package is looped with a strapping.

8 Claims, 6 Drawing Sheets

FIG. 2
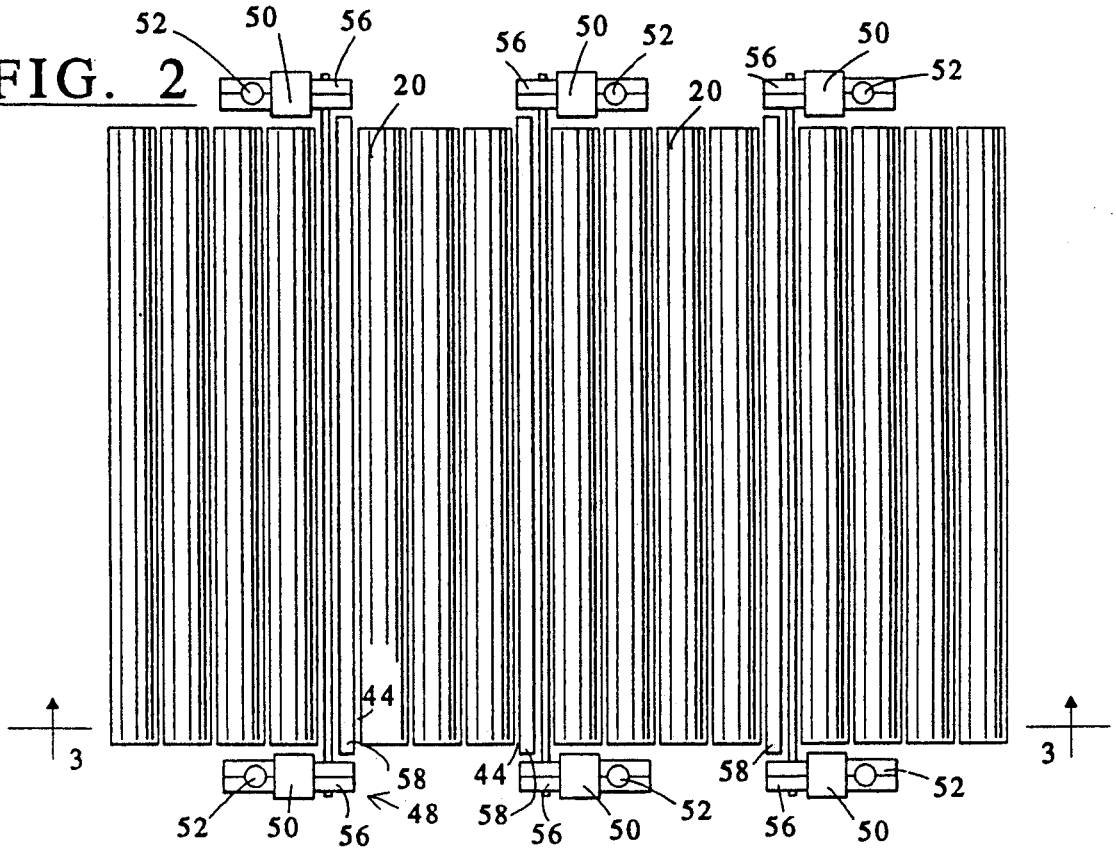
FIG. 3
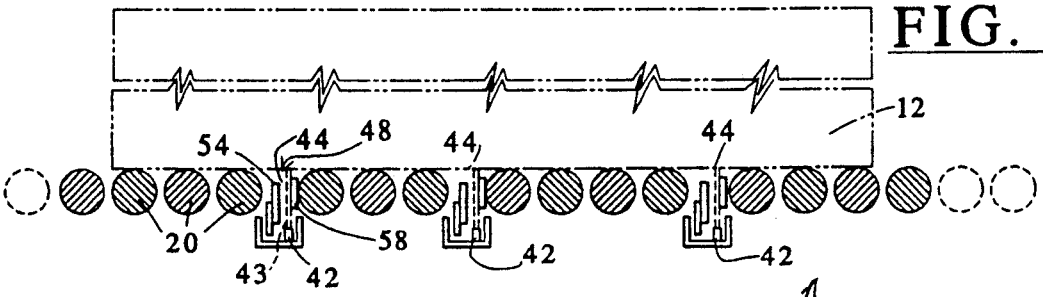
FIG. 11
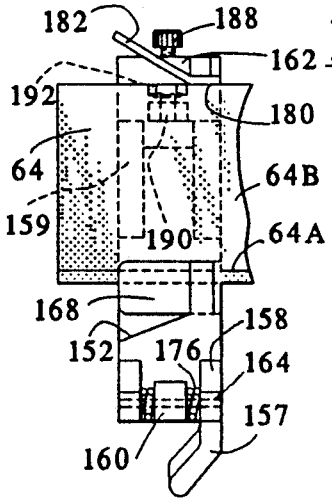
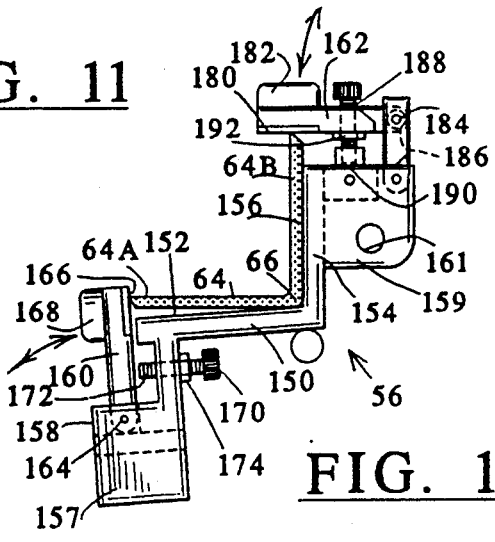
FIG. 10

EDGE PROTECTOR DELIVERY AND POSITIONING APPARATUS AND METHOD

BACKGROUND OF THE INVENTION

1. Field of the Invention

This invention relates generally to apparatus for strapping of packages, bundles and other articles with encircling straps or bands, and more particularly to a system and apparatus for positioning edge protector pads at the edges of a package, article or bundle and maintaining the pads in place during the strapping operation.

2. Background Art

Large and bulky objects often require strapping together a number of similarly shaped items to provide an easily manipulated package for shipping. A traditional method of strapping used metal bands or straps disposed around the bulky items placed together in an ordered relationship. For most hard objects, such as bricks, a metal band does not present a considerable problem when it is tightened around the objects. However, for more pliable or crushable items, i.e. stacks of corrugated cardboard, wood products, such as veneers, plywoods, hardboards, and other products, the metal bands cut into the surface of the outermost items in a stack and often damage those outermost items to such a degree as to make them unusable for their intended purpose. Even plastic bands which have come into more general use are liable to damage easily crushable items, such as stacks of corrugated cardboard.

More recently, it has become general practice to interpose edge protector pads, also called simply edge protectors, between the edges of a package and the encircling strap to protect the package edges from damage.

Automation of the strapping process has necessitated development of an automated mechanism to position the edge protectors onto the edge of a package bundle or stack of items and to retain the edge protectors thereon while the straps are being tightened. As in many manufacturing or industrial processes, a significant goal is to achieve the most cost-effective solution to a particular problem. As applied to edge protector positioning, the goal has been to design a system and apparatus which is effective in maintaining the edge protector position during strapping or banding and capturing the strap or band over a central portion of the edge protector in all instances. Another goal has been a reduction in the cost of the positioning apparatus and also a reduction in the cost of the individual edge protector pads.

An inexpensive material used for edge protector pads is cardboard or laminated paper which has been folded to approximately a 90° angle to fit over an edge of a stack or bundle of items. A continuous edge protector along all the edges of a bundle or stack alleviates the need for precise positioning of the edge protector during the banding process. For example, U.S. Pat. Nos. 3,398,675 and 4,513,864 each disclose a continuous edge protector for protecting the complete edge of a stack, band or coil of materials. However, providing continuous edge protectors for each of four or eight corners of can become an expensive proposition.

Shorter length edge protector pads have been used to reduce the expense involved in packaging bundles or stacks of items, see, for example, U.S. Pat. Nos. 2,630,214, 3,271,925, and 3,995,409. Precise positioning of the shorter length edge protector is a major consideration, because the strap must securely grip the edge protector pad without slipping off when the strap is tightened. If the strap is tightened when the edge protector pad is not centered beneath the strap, tightening of the strap lifts an opposite side of the edge protector which increases the probability that the strap will slip from the edge protector and onto the bundle or stack of items which are being strapped. Strapping over an edge protector which is not properly centered creates uneven pressure of the edge protector on the package edge, and can cause damage thereto.

Various methods for positioning edge protectors have been proposed. U.S. Pat. No. 3,424,077 proposes a labor intensive manual positioning method which is not easily adaptable to automated equipment and which would also be overly expensive in requiring two operators, one for the strapping operation and the other for positioning the pads.

Automated mechanisms for positioning edge protector pads are described in U.S. Pat. Nos. 3,241,287 and 4,587,791. These patents describe edge protector delivery and positioning apparatus. The apparatus described by both of these patents require the magazine in which the edge protectors are stacked to be movable adjacent the package just prior to the strapping process.

Because the edge protector magazine, the delivery and positioning apparatus and the strap delivery apparatus all take up considerable space around the package, the number of straps which can be looped around most packages is limited to two if the strapping is to be performed simultaneously for each package. In many strapping machines, the strapping apparatus, called a strapping head, is disposed in series along a conveyor for delivering the package to be strapped. The limitation in space further limits the number of strapping heads per package edge to two under normal condition because otherwise the edge protector off delivery apparatus interferes with the delivery of the straps. Simultaneous strapping is normally desirable to produce consistently uniform packages and to speed up the packaging process.

Devices made according to the teaching of U.S. Pat. Nos. 3,241,287 and 4,587,791 also require the tolerances of the edge protectors themselves to be exact in the relative lengths and angular spread of the edge protector walls and in the shape of the edge protectors. Thus, to obtain the close tolerance on the edge protectors, the edge protectors provided are injection molded to and are essentially identical in their dimensions.

Similarly, U.S. Pat. Nos. 3,735,955 and 4,877,673 also provide for injection molded edge protectors. Various modifications of injection molded edge protectors are often necessary to provide a capability of centering the strap relative to the edge protector during the strapping process including, for example, a depressed section on the outer edge of an edge protector having angled sides. As the strap is tightened around a package, the angled edge sides of the edge protector guide the strap toward the center of the edge protector. Because the stress on the edge protector is great during the tightening of the strap, the required structural integrity of the edge protector mandates that it be manufactured by an injection molding process.

Injection molding becomes expensive when considering that each strap for a package must loop around four edges, requiring four edge protectors per strap. Many packages require two or more parallel straps and possibly at least one other additional strap in a transverse direction.

A less expensive alternative to injection molded edge protectors are edge protectors comprising short pieces of laminated paper products, such as pieces of cardboard discussed above, that have been bent along a central line transverse to the longer dimension of approximately a right angle. Edge protectors having acceptable characteristics are presently available. However, the tolerances of laminated cardboard edge protectors are not subject to efficient control.

Inexpensive laminated cardboard edge protectors are now available for use, but their use in an automated positioning apparatus has heretofore been limited by the large variability dimensions of the edge protectors. Dimensions of the different lengths of each of the flanged sides of the edge protector typically range from about 1¾" to about 2¼". The nominal length of each leg is 2 inches, i.e. a flat laminated cardboard strip 4 inches long is folded over at its approximate center. That folding process is not precise, however, and ¼ inch variability in each leg is common. The angle between the two sides may have a typical value from 80° to about 105°.

A great range in dimensional variability of the edge protectors is not desirable from the standpoint of automated edge protector delivery and retention apparatus. Mechanisms to transfer edge protectors from an edge protector magazine to the edge of a package for strapping should be capable of accepting the high degree of variability in the available laminated cardboard edge protectors and dispose them under the strap during the strap tightening step with both reliability and efficiency.

Thus, what is necessary is a reliable and accurate edge protector delivery, positioning and retention apparatus which can accept a high degree of variability in the individual edge protectors dispensed from a magazine to continue operation of a strapping device. Another desirable characteristic is the capability of retrofitting the positioning apparatus in existing strapping machines without necessitating the excessive reconfiguration of any existing strapping machine structure. Yet another desirable characteristic which is needed is a compact positioning apparatus for delivery positioning and retention of edge protectors during strapping of a package, which apparatus is narrow enough to permit disposition of at least three of these apparatus in side by side relationship per edge of each package, for retrofitting a strapping machine having at least three strapping heads.

SUMMARY OF THE INVENTION

Accordingly, there is disclosed herein a positioning apparatus for positioning and retaining an edge protector at an edge of a package to be looped with a strapping, the edge protector having at least one package contacting surface and at least one package non-contacting surface, and the apparatus comprises an edge protector magazine for retaining stacked, nested edge protectors including a magazine delivery station for systematically dispensing individual edge protectors to be dispensed, a saddle shuttle assembly for transporting each individual edge protector from the magazine delivery station to the edge of the package, the saddle shuttle assembly including at least one forwardly extending clip orienting and retaining each individual edge protector on the saddle shuttle assembly while it is being transported to the package edge, a pusher for selectively driving an edge protector from the magazine delivery station onto the saddle shuttle assembly, the pusher including a pushing surface normal to the longitudinal axis of the edge protector and means to reciprocate the pusher between the magazine delivery station and said saddle shuttle assembly and retaining means for applying a substantially normal force to the at least one package non-contacting surface of the edge protector, the retaining means retaining the edge protector immediately adjacent the package edge and the edge protector package contacting surface in conforming relation to the edge while the package is looped with a strapping.

BRIEF DESCRIPTION OF THE DRAWINGS

FIG. 2 is an elevational view of several of the inventive edge protector delivery systems disposed in series along a conveyor line;

FIG. 3 is a cross-sectional view of the view shown in FIG. 2 taken approximately along the line 3—3;

FIGS. 10 and 11 are detailed elevation views, viewed at right angles from each other, of the saddle assembly according to the present invention.

DETAILED DESCRIPTION OF THE PREFERRED EMBODIMENT

Figure 1:
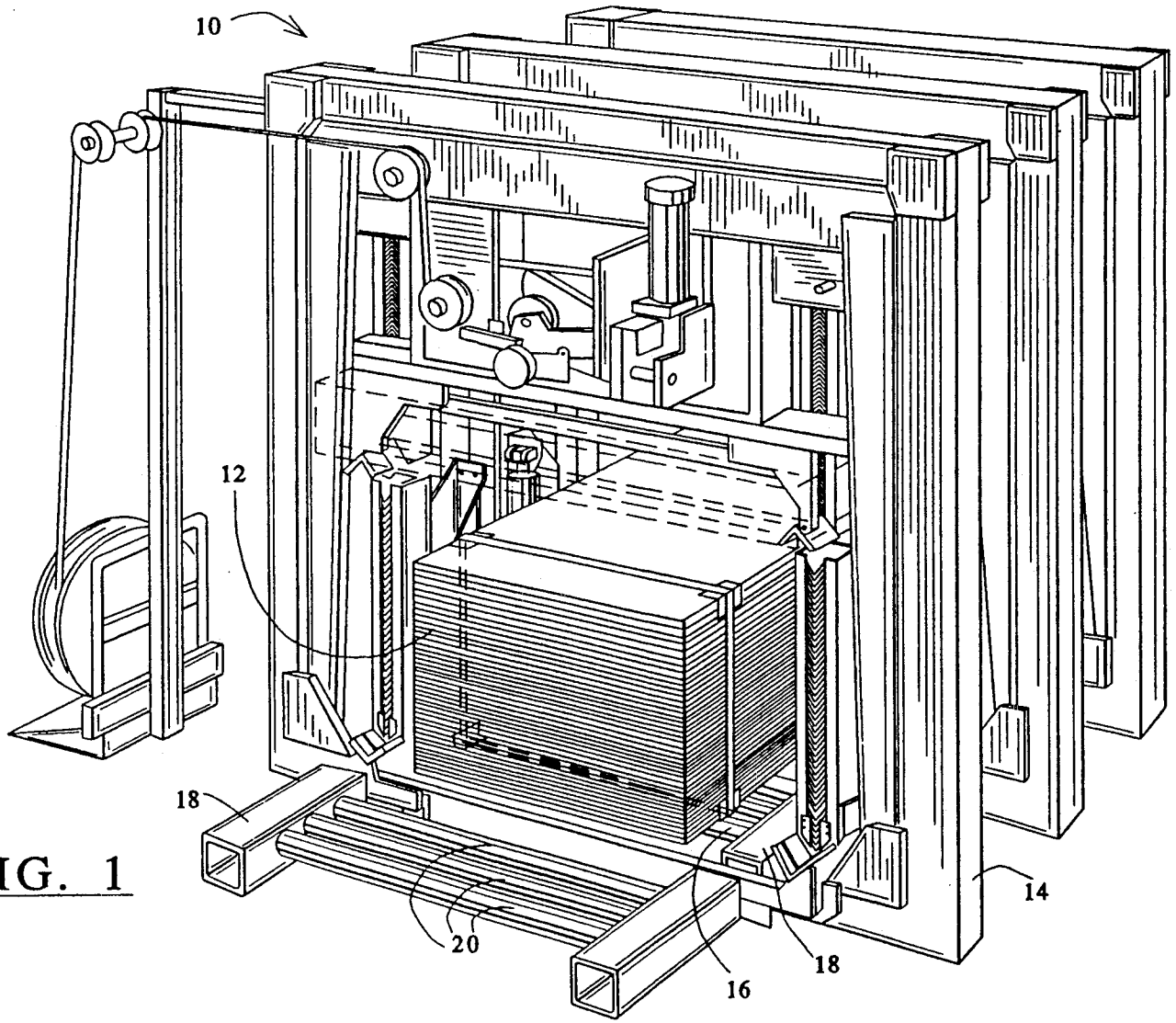
FIG. 1 is a perspective view of a strapping machine having an inventive edge protector delivery system.

FIG. 1 shows a schematic perspective view of a strapping machine 10 used to strap a package 12 comprising, for example, a stack of corrugated cardboard pieces. Stacks of other materials may also be strapped, including lumber, plywood sheets and other stackable products. A single strapping machine 10 defining a strapping station 14 is shown for clarity. It should be understood that one feature of the present invention is its compactness which permits its use with multiple closely-arranged strapping machines for simultaneous strapping of a package 12.

The package 12 is transported to the strapping station 14 by a conveyor 16. The conveyor 16 comprises a conveyor frame 18 and a series of rollers 20 connected to the frame 18. The packages 12 are transported over the rollers 20 and are stopped at the appropriate strapping station 14 along conveyor 16.

As is more readily visible in FIGS. 2 and 3, the rollers 20 are spaced together in groups. FIG. 2 shows in a top elevational view a standard configuration of rollers 20 having predetermined spacing between each individual roller 20 in a particular group also a predetermined spacing between each of the groups.

The groupings shown in FIGS. 2 and 3 are presently utilized in standard strapping machines having three strapping tracks 42 as shown, which are used in conjunction with three strapping heads. The strapping heads are each shown in conjunction with an edge protector delivery system according to the present invention. Strapping heads in present use either have no edge protector delivery system or a system which is so bulky that it may not be usable with a strapping machine having three strapping heads and three strapping tracks 42. Alternatively, use of available strapping machines which provide an edge protector delivery system for three strapping heads would require rearrangement of the rollers into a configuration that provides a greater spacing between each of the strapping tracks 42. For example, the roller configuration may group five rollers together in each group to permit use of available edge delivery systems for all three strapping tracks and heads. The compactness of the inventive delivery system is a feature that provides the distinct advantage of permitting retrofitting of strapping machines to incorporate edge delivery systems for each of three, or more, tracks without necessitating excessive reconfiguration of the rollers 20. Of course, the inventive delivery system is also usable with a single or double strapping head configuration, as is desired by the end user.

The standard strapping machine provides a roller configuration as shown in FIGS. 2 and 3 for a single strapping station. Each roller 20 is 3¼ inches in diameter and the centerline of adjacent rollers within a group are 3½ inches apart leaving a space between rollers 20 of about ¼ inch. The space 44 between rollers in adjacent groups is 2½ inches, which space must be utilized for incorporation of both the strapping track 42 and the edge protector delivery systems, indicated generally at 48. These dimensions are typical but roller sizes also vary as do the spacing distances between the rollers both within groups of rollers and between the roller groups.

The axial length of the rollers 20 may vary according to the strapping machine used. The roller length may be any size which will accommodate a range of package sizes for the packages 12 which are anticipated for strapping. Specific size rollers may be used to accommodate a particular size or sizes in the packages 12, one of which is shown in phantom in FIGS. 2 and 3.

Each edge protector delivery system 48 shown in FIGS. 2–3, comprises an edge protector magazine 50, a pusher assembly 52, a shuttle assembly 54 which includes a saddle assembly 56, and a retaining bar 58. In the interest of a clear description, the edge protector delivery system 48 shown in FIGS. 2–3 is for delivering edge protectors to the bottom edges of a package. Description of the edge protector delivery system for a bottom edge becomes cumbersome or confusing when the description is directed to edge protector delivery systems for both a bottom edge and a top edge. However, it is to be understood that the description of details of the system 48 applies equally to a system utilized for delivery of edge protectors adjacent an upper or top edge with certain necessary modifications. For example, certain elements of the system would be inverted. Other modifications may also be necessary, such as including a frame and a platen extension for attaching an edge protector delivery system at the appropriate positions of the platen adjacent each strapping track so that the edge protector delivery system is horizontally at the same height as the top edges of the package 12.

Figure 8:
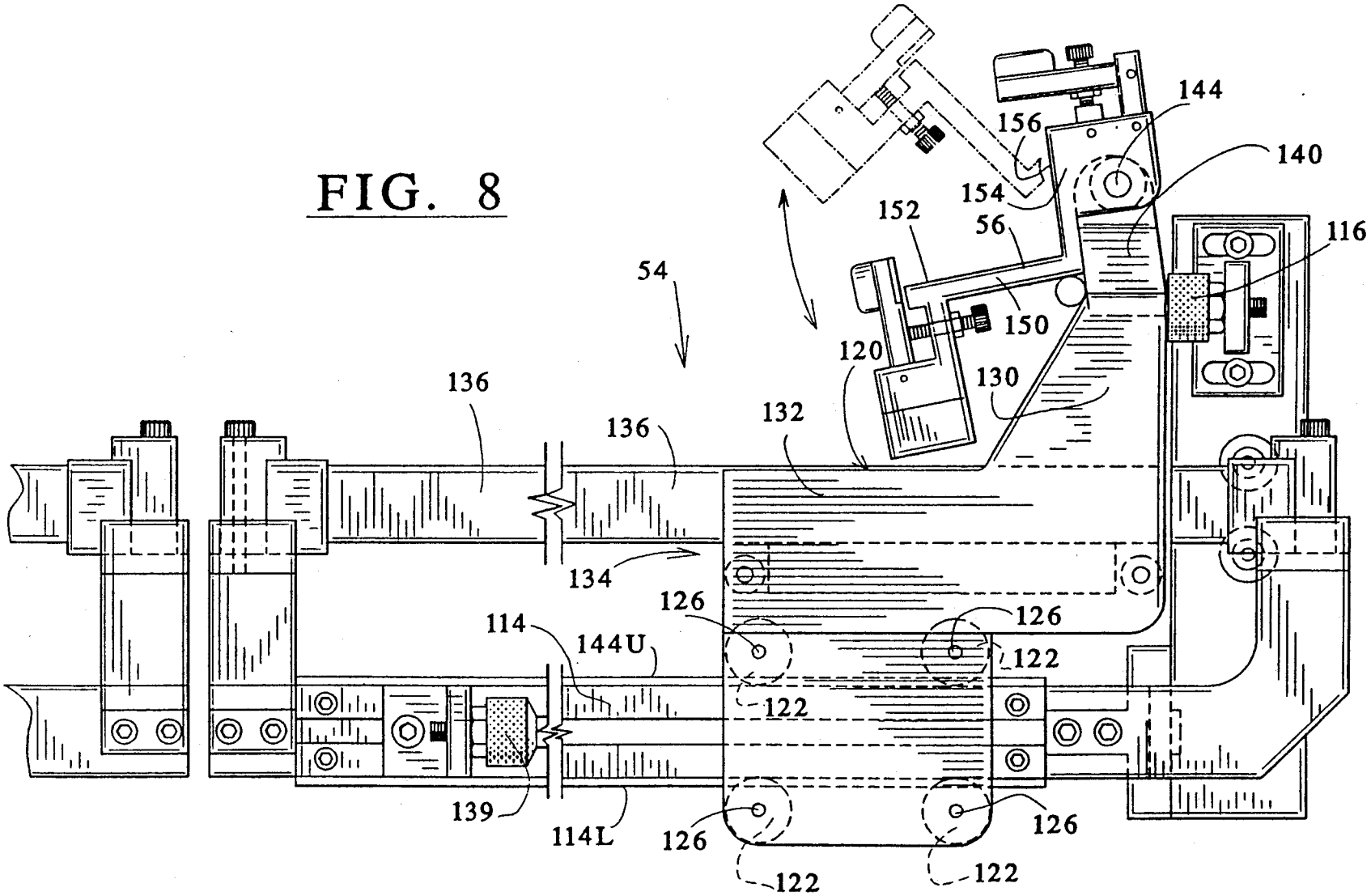
FIGS. 8 and 9 are partially cutaway elevation views of the edge protector shuttle assembly.
Figure 9:
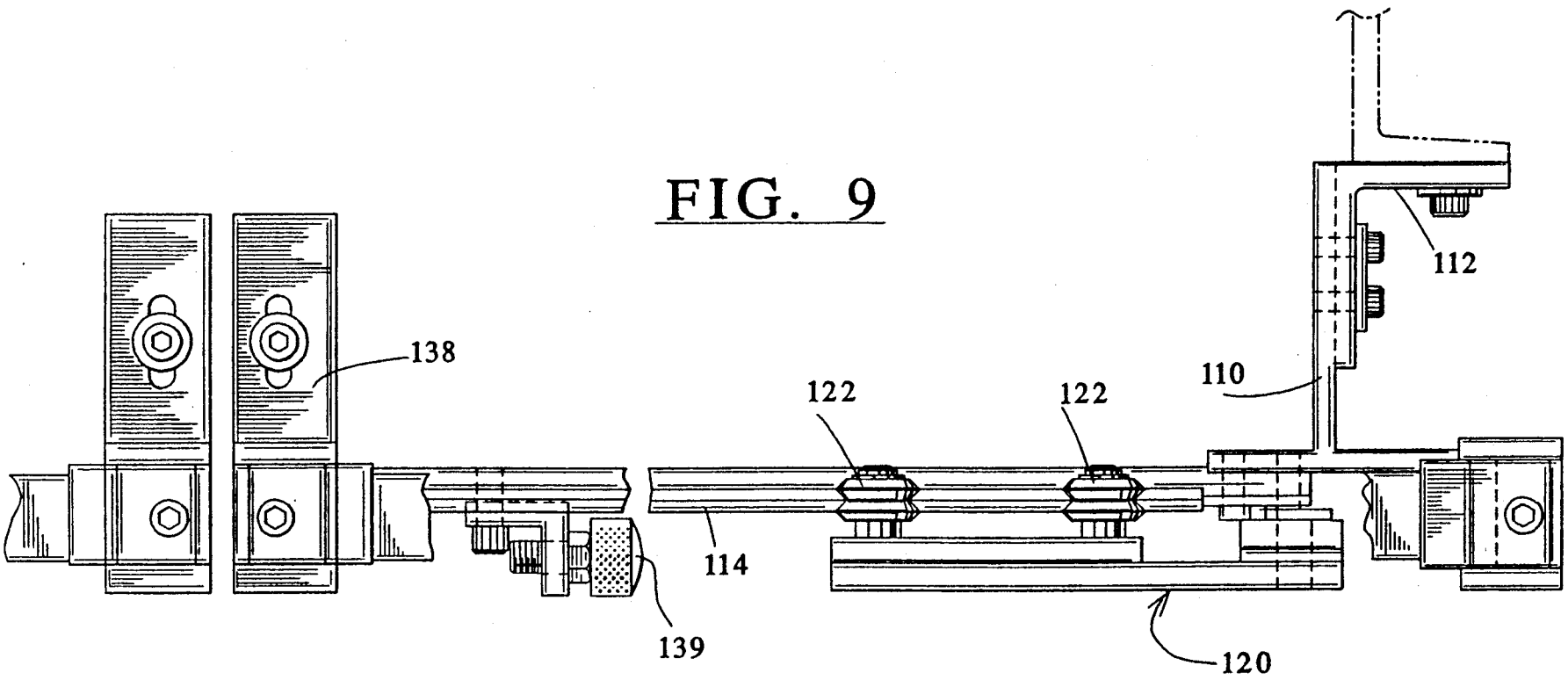

It should also be understood that for each strapping head at least two separate edge protector delivery systems would be necessary, one for each of the bottom edges around which an individual strap would be wound. The edge protector delivery systems for each of the bottom edges would be essentially identical except that they would be mirror images of each other. That is one would be a right handed system and the other would be a left handed system, both of which would be centered on the identical strapping track 42 at the respective lateral edge of the conveyor rollers. FIGS. 8 and 9 show a portion of both a right handed and a left handed system which operate simultaneously to provide an edge protector for the same strap being wound around the package 12.

Figure 4:
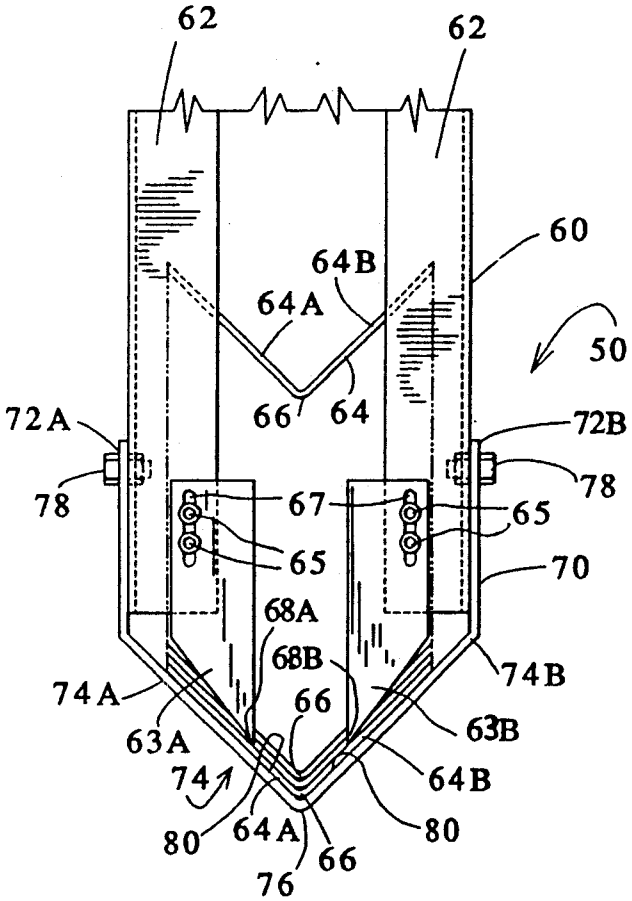
FIG. 4 is an elevational view of the inventive magazine including a stack of edge protectors.

Referring now to FIG. 4, an edge protector magazine 50 is shown in an elevational view. The magazine 50 comprises a U-shaped hopper 60 having two inwardly turned, vertically extending ends 62 which define a longitudinal opening between them. A plurality of edge protectors 64 are stacked within the hopper 60 and are partially visible through the longitudinal opening between ends 62. The ends 62 each include at the lower most portions angled edges 63 which have an angle of approximately 45° relative to the vertically extending ends 62. Each edge protector 64 is a laminated cardboard strip approximately 4–5 inches long and 2¼ inches wide. The cardboard strip of edge protector 64 is folded along a line 66 which is parallel to the shorter width of the strip, thus providing an edge protector 64 which has an L-shape in cross-section. The line 66 is approximately half way along the length of the strip and defines two legs 64A, 64B of the edge protector which are approximately of equal length. The angle between the two folded legs 64A, 64B is in a range of from about 80° to about 105°, with a majority of the edge protectors having an angle of about 95°. The size of the edge protector can also be variable, and the stated sizes and angles set forth above are only typical. Adjustments of the components are possible which would permit other dimensions of the edge protectors than the illustrative example described above.

The exact dimensions of each edge protector 64 are not critical to utilize the edge protectors in the inventive edge protector delivery system 48, as the structure invention accommodates edge protectors 64 which have a wide variability in the respective lengths of the legs 64A, 64B and the angle between them, as will be explained below.

The stack of edge protectors 64 is disposed within the hopper 60 with the legs 64A, 64B facing up and the fold line 66 in the lowermost position for dispensing out of the magazine 50. The magazine 50 includes a V-shaped bottom wall member 70 having two parallel legs 72 for attaching the bottom wall member 70 to opposite sides of the hopper 60 by means of an appropriate attachment means such as the nut and bolt 78 shown in FIG. 4.

The bottom wall member 70 further includes two angled leg extensions 74A, 74B, one each attached to the legs 72A, 72B, at one end, and also attached to each other along a fold line 76 at their respective other end. The included angle between the leg extensions 74A, 74B is approximately 90°. An overhanging ledge 75 seen in FIG. 6, extends leg extensions beyond the vertical wall of the magazine 50. In the preferred embodiment, the bottom wall member 70 is a unitary strip which has been folded at the appropriate positions to provide the elements in an integral member 70. The fold between the two leg extensions 74A, 74B at the fold line 76 provides a V-shape to the bottom wall member 70 which shape approximately matches the shape of the individual edge protectors 64.

One feature of the magazine 50 is that attaching the bottom wall member 70 to the opposite walls of the hopper 60 provides for an opening 80 between the body of magazine 50, and more specifically, between the vertically extending ends 62, and the leg extensions 74A, 74B. The width of the gap or opening 80 is very important in that it must be narrow enough to permit only one edge protector 64 at a time to be ejected from the magazine 50 while simultaneously permitting ejection of edge protectors 64 having a wide range of variation in lengths of edge protector legs 64A, 64B and in the angle between them. Adjustability of the width of the opening 80 would also be a desirable feature.

Accordingly, extension stripper brackets 63A, 63B are mounted on the magazine 50 and specifically are attached to the vertically extending walls 62 which are closest to the shuttle assembly 54. One each of the stripper brackets 63A, 63B is attached to each wall 62 by a pair of studs 65 which extend through a longitudinally extending slot 67 in each of the brackets. The slot 67 has a width which is slightly larger than the bolt of studs 65 but smaller than the head or nut of the studs. When tightened the stud's heads or nuts hold the stripper brackets 63A, 63B at a predetermined vertical position relative to the magazine 50 and the bottom wall 74 while simultaneously inhibiting angular rotation of the brackets.

Each of the lower ends of the stripper brackets 63A, 63B ends in points 68A, 68B, respectively. The angle between the two edges defining the point 68 should be substantially less than 45° to provide better control over the spacing width of the opening 80, for the reasons explained below. An appropriate range for the included angle may be from about 30° to about 40° from the vertical. Thus, although the spacing of the opening 80 between the points 68A, 68B and the inner surface of the walls of leg extensions 74A, 74B is at a predetermined width, the remainder of the extension stripper bracket 63A, 63B may be at a greater distance from the inner wall surface of the leg extensions 74A, 74B. The distance or spacing of the remainder of the stripper brackets 63A, 63B from the wall surface is inconsequential because the points 68A, 68B will be sufficiently rigid to hold back any other edge protector except the bottom one from being ejected from the magazine 50.

The width of opening 80 is controllable by adjustment of the vertical position of the stripper brackets 63A, 63B. Vertical adjustment of the extension stripper brackets 63A, 63B is accomplished by loosening the head or bolt of stud 65 thus allowing the brackets 63A, 63B so that the stripper brackets 63A, 63B can slide freely up and down past the studs 65 along the respective longitudinal slots 67. The relative position of the stripper brackets 63A, 63B preferably are adjusted to provide a width in the opening 80 which is approximately 1.75 times the mean thickness of the edge protectors 64 which are contained within the magazine 50.

A spacing in the gap 80 that is just smaller than two edge protectors thicknesses would permit the ejection of an edge protector having a wide range of leg lengths and of included angles, but would also retain the edge protector next to the bottom one within the magazine 50. This will occur even if the edge protectors 64 have a shape which exactly matches that of the opening, i.e. the surfaces of the edge protectors 64 are parallel to the inner wall surface of the leg extensions 74A, 74B. On the other hand, if the included angle of the edge protectors 64 is greater than 90°, the edge protector fold 66 will be raised and spaced to a slight degree from the fold 76 of the bottom wall leg extensions 74A, 74B. The difference in the spacing of the gap 80 provides enough leeway to permit the edge protector included angle to be up to about 105° between the edge protectors legs 64A, 64B and still ensure that the edge protector can be ejected. Conversely, if the included angle between the edge protector legs 64A, 64B is smaller than 90°, e.g. about 80°, one of the legs will be raised somewhat from the surface of the bottom wall leg extensions, either 74A or 74B. However, because the angle of the walls of the stripper brackets 63A, 63B is set at substantially less than 45°, i.e. 30°–40°, there will be enough clearance to accommodate a greater variety of edge protectors having a smaller included angle while again only permitting the ejection of one edge protector 64 at a time from the magazine 50. Thus, dispensing of edge protectors 64 from the magazine 50 occurs one at a time because only a single edge protector 64 will be able to fit through the opening 80.

Figure 5:
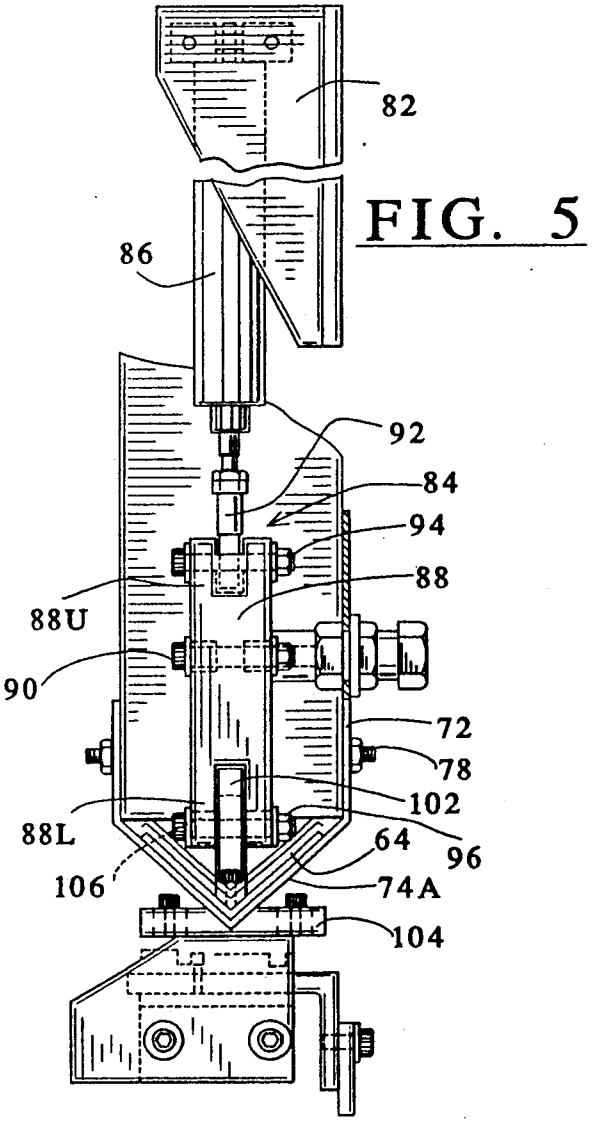
FIGS. 5 and 6 are elevational views, taken at right angles to each other, of the inventive pusher assembly and magazine.
Figure 6:
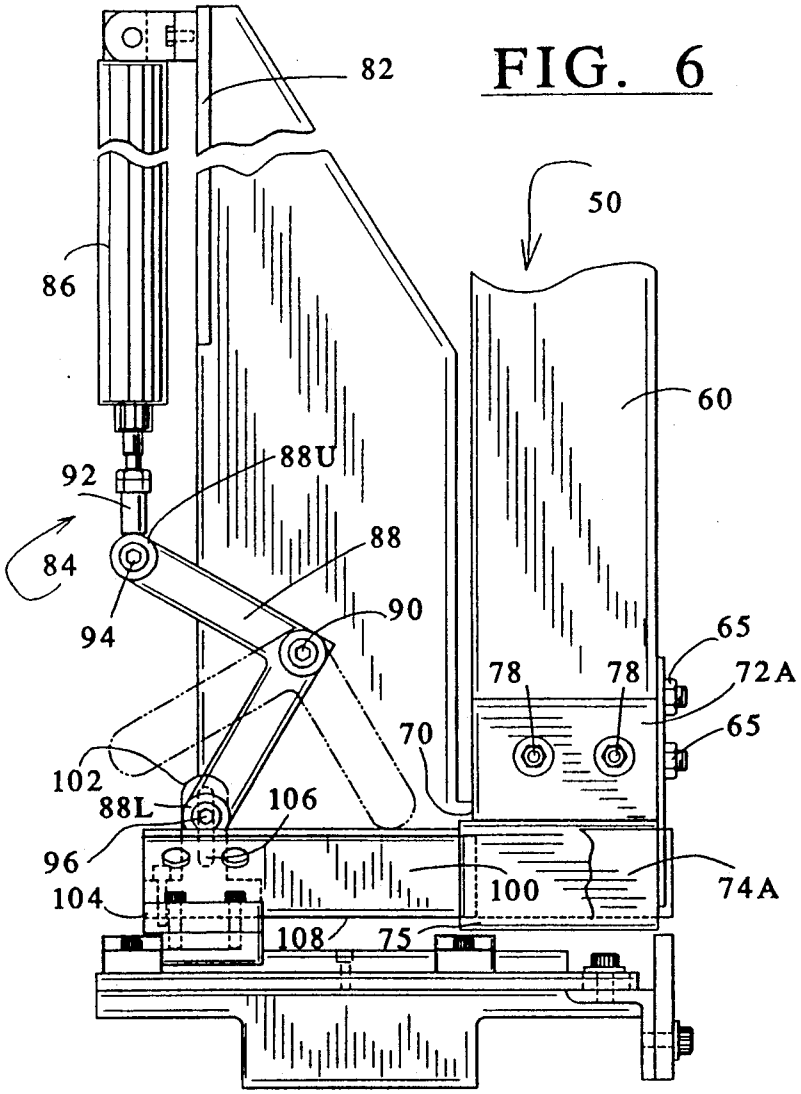

The edge protectors 64 are dispensed from the magazine by the edge protector pusher apparatus 52. FIGS. 5 and 6 illustrate the pusher apparatus in two elevational views taken at 90° relative to each other. The pusher apparatus 52 operates in conjunction with the edge protector magazine 50. The magazine 50 in FIG. 6 is shown normal to the view of FIGS. 4 and 5 and is partially cut away for purposes of clarity.

The pusher apparatus 52 consists of a pusher support bracket 82 which is attached to a frame of a strapping machine 10 (see FIG. 1) by an appropriate means. Referring again to FIGS. 5 and 6, the support bracket 82 operates in conjunction with a pusher assembly 84 to dispense individual edge protectors 64 (shown in phantom, FIG. 5) out of the magazine 50. The pusher assembly is connected to an automatically controlled pneumatic piston 86 through an L-shaped linkage 88. The linkage 88 swivels about a stationary pivot bolt 90 to a position as shown in phantom in FIG. 6. Activation of the piston 86 causes the piston rod 92 to descend, thereby depressing the swivel bolt 94 by which it is connected to an upper end 88U of the L-shaped linkage 88. Thus, depressing the upper end 88U of the linkage causes the linkage 88 to pivot about the pivot bolt 90, causing the other or lower end 88L of the linkage 88 to be swung in an arc toward the right in FIG. 6. The other end of linkage 88 carries a second swivel bolt 96 which is connected to the pusher assembly 84.

The pusher assembly 84 comprises a pusher blade 100 connected to a slide yoke 102 and is also connected, by an appropriate means such as the screws shown, to a blade mounting block 104. The slide yoke 102 further includes an elongated aperture 106 through which the swivel bolt 96 of the linkage 88 extends. Thus, as the linkage lower end 88L swings in an arc toward the right, the swivel bolt 96 is free to move up and down within the elongate aperture 106 while simultaneously transposing the slide yoke 102 and the pusher blade 100 toward the right.

The pusher blade mounting block 104 rests loosely on a mounting block guide 110 of the pusher support bracket 82. While bracket 82 provides a vertical support to the pusher blade 100, it provides freedom for horizontal motion of the mounting block 104 along the mounting block guide 110.

The pusher blade 100 is in the shape of a V in cross-section (see FIG. 5) comprising two wings 100A, 100B joined together at an angle of approximately 90° at a fold line 108. The pusher blade 100 is of a thickness, shape and configuration to permit the pusher blade to fit within the opening 80 formed by the edges 63A, 63B and bottom wall 74A, 74B of the edge protector magazine 50. Moreover, the mounting block guide 110 of the pusher support bracket 82 and the fold line 108 of the pusher blade 100 are both parallel to the fold line 76 of the bottom wall members 74A, 74B. Accordingly, as the pusher blade 100 is inserted into the opening 80, the wings 100A, 100B transverse along the inner surface of the walls 74A, 74B and the bottom of the fold line 108 runs parallel along the inside of the fold line 76.

The length and stroke of the pusher blade 100 is sufficient to extend the pusher blade 100 completely through the edge protector magazine 50. The alignment of the pusher blade 100 within the openings 80 extends the pusher blade 100 through the opening 80 when the piston rod 92 is in its lower most position and the linkage 88 is in a most inwardly extended position, as is shown in FIG. 6 by the phantom lines.

When the piston rod 92 retracts to the up position, shown in FIG. 6 by solid lines, the linkage 88 retracts the pusher blade 100 completely out of the magazine 50 so that the distal end of the pusher blade 100 rests on the overhanging ledge 75. In this position, the lowermost edge protector 64 becomes aligned with the openings 80 and is ready for dispensing through the succeeding stroke of the pusher blade 100.

Figure 7:
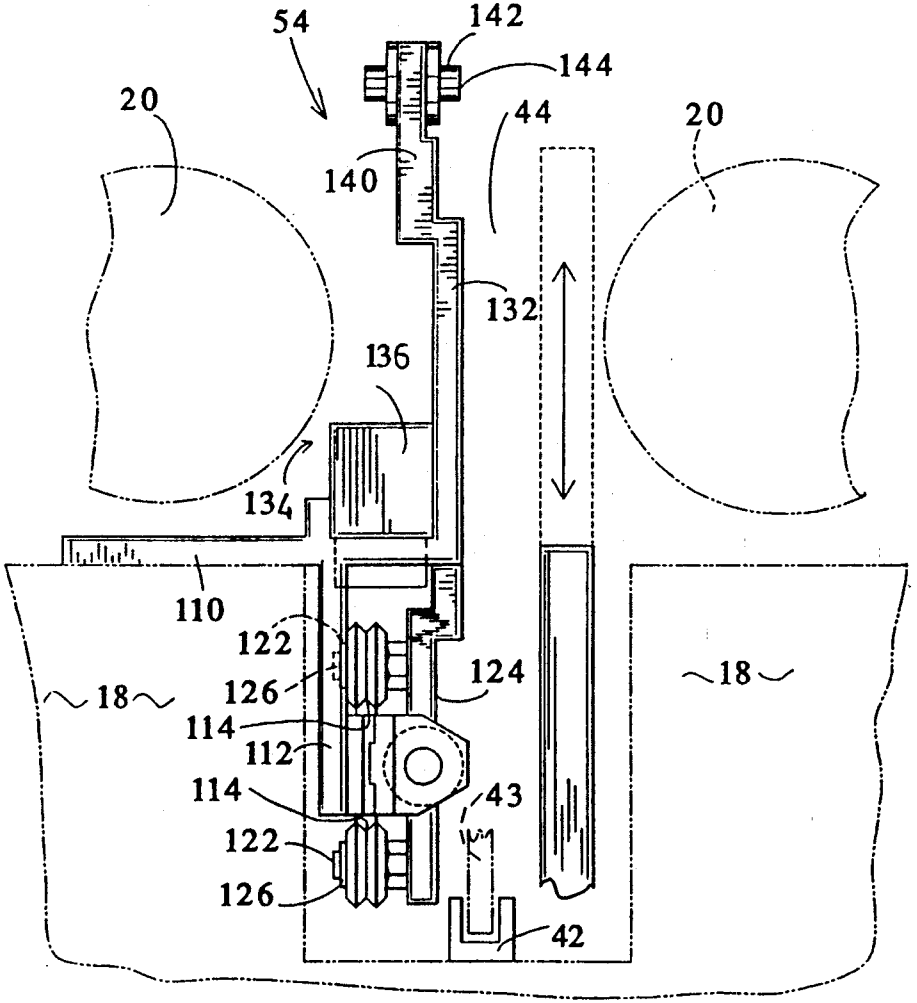
FIG. 7 is a detailed elevation view of one of the edge protector delivery assemblies according to this invention.

Referring now to FIG. 7, shuttle assembly 54 is shown in an elevational view and includes elements in a detailed view comprising the shuttle assembly disposed in an opening of the conveyor frame 18 and between two rollers 20, shown in phantom. FIG. 7 is a detailed view of a portion of the channel defined by the opening 44 (FIG. 3). The shuttle assembly is compact and takes up only a portion of the lateral space of the frame opening 44 and provides room for a retaining bar 58 and for a strapping track 42 between the shuttle assembly 54 and the retaining bar 58.

The shuttle assembly 54 is shown in FIGS. 7–9 in elevational views taken normal to each other. In each view, the identical elements will be identified by using the same reference numeral. The shuttle assembly 54 is attached to the sides of the channel in the frame 18 by means of mounting brackets 110, 112 which are attached to the side walls of the frame by mounting screws as seen in FIG. 9.

The mounting brackets 110, 112 are attached to and mount a steel guide track 114 having two pointed vertically extending ends, an upper end 114U and a lower end 114L. The steel guide track 114 provides a rolling track and guide for horizontal movement of a shuttle frame, herein referred to simply as a shuttle 120. A rubber stop member 116 is adjustably mounted on the frame 18 and engages the shuttle 120 to prevent the shuttle from moving beyond the magazine delivery station. Adjusting the stop member 116 permits an operator to fine tune the exact position for the saddle assembly 56 to accept an edge protector as it is being dispensed.

The shuttle 120 includes four sets of guide wheels 122, the guide wheels being connected to a lower portion 124 of the shuttle 120 by a plurality of guide wheel axles 126, one each for each set of guide wheels. Each set of guide wheels 122 comprises two annular disks, 122A and 122B, each having a triangular shaped outer circumference 122C which engages the triangular shaped, pointed upper end 114U and lower end 114L of the steel guide track. The four sets of guide wheels are in a rectangular configuration in a common plane with the upper sets of guide wheels being directly above the lower sets. Movement of the shuttle 120 is restricted only to the horizontal direction of travel along the path of the steel guide track 114 by the tight engagement of each set of guide wheels 122 with the upper and lower ends 114U, 114L respectively, of the steel guide track 114.

The upper portion 130 of the shuttle 120 is connected to the lower portion by an intermediate portion 132. The intermediate portion includes an appropriate transport means 134 by which the shuttle 120 is horizontally shifted along the steel guide track 114 to the appropriate delivery station alongside an edge of a package 12. The transport means 134 shown in FIGS. 7–9 comprises a rodless pneumatic cylinder or band cylinder 136, but other transport means (not shown) may be used.

The upper portion 130 of the shuttle includes an outwardly extending tab 140 having a tab aperture 142 through which a saddle assembly dowel pin 144 is inserted. The dowel pin 144 provides an attachment for the saddle assembly 56 (shown in phantom) and around which the saddle assembly is rotatable, as will be explained below. FIG. 8 shows that the extending tab 140 is slightly inclined from the vertical to permit the bottom wall of the saddle assembly 56 to be angled relative to the horizontal when the saddle assembly is rotated in the package engagement position, as shown in FIG. 8 by the phantom lines indicating a lower saddle arm. Reference to FIG. 7 shows that the dowel pin 144 positions the saddle assembly 56 so that when in the package engagement position, the bottom wall 152 angles slightly below the horizontal at a position just below the top surface of the rollers 20 upon which the package 12 rests. When the shuttle 120 is transported to the package 12, the bottom wall 152 of the bottom saddle arm 150 will slide under the package lower edge.

FIGS. 8 and 9 illustrate the steel guide track 114 and the rodless pneumatic cylinder 136 as being cutaway. This cutaway is for purposes of clearer illustration, because showing the full length of these elements to scale would render in miniature the other elements of the shuttle assembly 54 and would not indicate the necessary detail. The actual length of the steel guide track 114 and the rodless pneumatic cylinder 136 is slightly longer than one-half of the length of the rollers 20 which extend across the full width of the conveyor.

The conveyor centerline separates two independently operated saddle assemblies 54, a right handed one (shown almost complete in FIGS. 8–9) and a left handed one for delivering edge protectors to the opposite side of the package 12, (partially shown in FIGS. 8–9). When a package arrives at the strapping station, both shuttle assemblies transport the respective saddle assemblies 56 toward the centerline upon receiving an appropriate signal from a control mechanism (not shown). If the package is not centered exactly on the conveyor centerline, one saddle assembly 56 will reach the respective package edge before the other, but both saddle assemblies will eventually stop at the package edge, delivering and positioning the edge protector just prior to the strapping operation.

The steel guide track 114 and the rodless pneumatic cylinder 136 are attached to the frame 18 adjacent the centerline by an appropriate mounting means, such as the bracket 138 and a plurality of machine screws as shown. To prevent the saddle assemblies from colliding with the bracket 138, a rubber stop member 139 is attached to the steel guide track 114 at a point close to the bracket 138. The stop member 139 is a barrier to further horizontal movement of the saddle assembly 54 when the lower portion 124 of the shuttle 120 encounters the stop member 139. The stop member 139 is disposed so close to the centerline that only when a package 12 is not correctly disposed at the strapping station 14 will the shuttle 120 encounter the stop member 139. In such a case, a default mode of the strapping machine may cause it to abort the strapping procedure until examination and resetting of the apparatus by an operator.

The saddle assembly 56 is the apparatus which receives an edge protector 64 after it has dispensed from the magazine 50 and holds it in place while the shuttle assembly 54 delivers the edge protector to the package edge. The invention provides a saddle assembly that is capable of receiving edge protectors 64 having a wide variability in the lengths of the legs 64A, 64B and in the included angle between them. An unloaded saddle assembly 56 is shown in FIG. 8 that is, the saddle assembly 56 is shown after it has delivered an edge protector 64 to the edge of a package 12 and is in the return cycle whereby it is traveling toward the magazine 50 to receive another edge protector. FIG. 10 shows in a detailed view a saddle assembly 56 which has received an edge protector 64 and is in a position to deliver the edge protector to the edge of package 12.

Referring now to FIGS. 8, 10 and 11, the saddle assembly comprises a lower leg 150 having a lower leg inner wall 152 and an upper leg 154, having an upper leg inner wall 156. The lower leg 150 provides at least one extension 158 for mounting a retention clip 160. Similarly the upper leg 154 provides at least one extension 159 on which a retention clip 162 is mounted. An orifice 161 in the extension 159 provides a means to mount the saddle assembly 56 on the shuttle 120. Preferably, a pair of extension members are disposed for each extension 158, 159 each with a respective aperture for mounting a retention clip 160, 162 between a respective pair of extension members. Insertion of the dowel pin 144 through the tab aperture 142 and through the orifice 161 permits the retention clip 162 to pivot about the dowel pin 144 (FIG. 8). A strap guide 157 is connected to the extension 158 for guiding the strap to a central edge protector location, as will be explained below.

The two inner walls 152, 156 are at an angle to each other of about 100°. An edge protector 64 which has legs 64A, 64B at a right angle to each other, is shown in FIGS. 10 and 11. It must be noted that the position of the edge protector 64, and especially of the lower leg 64A, relative to the edge of the package (not shown in FIGS. 8 or 10) is important in delivering the edge protector to the exact position on the package edge which is desired. As will be explained below, the complete saddle assembly 56 is rotated during a strapping cycle. Thus, a means is described below for retaining the edge protector in place in the saddle assembly 56 during the edge protector delivery cycle.

The saddle assembly 56 includes the lower leg retention clip 160 and the upper leg retention clip 162 which are in most respects identical to each other. Lower leg retention clip 160 pivots about a roll pin 164 which is inserted through the appropriate apertures in the clip 160 and the pair of extension members 158. The clip further includes an edge protector gripper surface 166 for retaining the end of the edge protector leg 64A and a clip projection 168 having an inner surface at an acute angle relative to the gripper surface 166. The angle may be in a range from 20° to 50° relative to the gripper surface, with an angle of about 30° being preferred. An adjustable stop consisting of a bolt 170 having a distal end 172 and a hex nut 174 prevents inward pivoting of the retention clip 160 beyond a desired point.

Pivoting of the clip 160 is necessary to provide a clearance for the leg 64A during the insertion process of the edge protector 64 into the saddle assembly 56, as will be explained below. A biasing means, such as a spring 176, biases the retention clip 160 inwardly toward the edge protector 64 and the biasing force is of sufficient strength to bias the opposite leg 64B of the edge protector 64 against the inner wall surface 156 of the upper leg 154. When there is no edge protector 64 being retained within the saddle assembly 56, as in FIG. 8, the biasing force of spring 176 maintains the clip 160 biased against the stop surface provided by the distal end 172 of the bolt 170.

Detention clip 162 has a construction similar to that of clip 160, including an edge protector gripper surface 180 and a clip projection 182 having an inner surface at an acute angle to the gripper surface 180. The included angle relative to the gripper surface 180 may be in the range from 20° to 50°, with an angle of about 30° being preferred.

The retention clip 162 is attached to the saddle assembly through a roll pin 184 at an opposite end from the clip projection 182. The retention clip 162 can pivot about the roll pin 184 and a spring 186 provides a biasing force on the retention clip to keep the gripper surface 180 inwardly biased toward the edge protector 64.

One difference between the retention clips 161 and 162 is that the adjustable stop member, comprising a bolt 188 having a distal end 190 and a hexagonal nut 192 are all disposed on the pivotable retention clip 162. This is not a necessity for practice of the invention, and a stop member identical to that associated with retention clip 160 may also be used. It has been found, however, that disposing the stop member directly on the clip 162 provides a better retention capability, since the weight of the stop member provides an additional downward retention force of the gripper surface 180 on the edge protector leg 64B when it is in the horizontal position shown in FIG. 10.

The distal end 190 of the bolt 188 engages the wall of the extension 159 to impede further inward rotation of the retention clip 162 around roll pin 184. The length of the bolt distal end 190 is adjusted by screwing the bolt 188 to the desired position and fixing that position by tightening of the hexagonal nut 192. The angled clip projections 168 provide wedge effect for the insertion of the edge protector 64. Specifically, the insertion of the edge protector 64 into the saddle assembly 56 proceeds from the side in a direction parallel to the surfaces 152, 156. Adjustment of each of the stop member bolts 170, 188 to an expected range of lengths of legs 64A, 64B permits each gripper surfaces 166, 180 to engage the respective legs 64A, 64B of the edge protector 64 during the edge protector insertion process.

There is a smooth transition from the angled projections 168, 182 to the respective gripper surfaces 166, 180, so that as the edge protector 64 is inserted into the saddle assembly 54, the ends of the legs 64A, 64B first meet the respective projections 168, 182, thereby exerting an outwardly opening force on the clips 160, 162 contra to the inward closing force provided by the respective springs 176, 186.

Continued insertion of the edge protector 64 into the saddle assembly 56 causes the ends of legs 64A, 64B to engage the respective gripper surfaces 166, 180, (FIG.

10). At this point, the force of the springs 176, 186 will push the edge protector into the corner defined by the saddle assembly lower arm surface 152 and upper arm surface 156. It is important during this process to maintain the outer walls of legs 64A, 64B as close as possible to the upper and lower arm surfaces 152, 156, respectively, because the orientation of the lower arm surface 152 relative to the bottom edge of the package 12 will influence whether the edge protector is positioned squarely on the package edge when the edge protector is delivered thereat.

Describing a complete package strapping cycle, and referring again to FIGS. 1–3, the package 12 is rolled over the rollers 20 to a strapping station 14, where it is stopped. The operation of only one edge protector delivery system will be described, though it is understood that two such systems are present and operating for each strapping track 42, so that for a strapping machine having three strapping tracks 42, six edge protector delivery systems will be operating simultaneously and in unison.

Referring now to FIGS. 4–6, 10 and 11, the pusher assembly 52 is activated, either automatically or by an operator. The activation depresses the pneumatic piston rod 92 which causes the linkage 88 to push the pusher blade 100 into the edge protector magazine 50 through the opening 80. As the pusher blade 100 moves through the magazine, it engages a single edge protector 64, which the pusher blade 100 completely pushes out of the opening 80 on the opposite side of the magazine.

During this portion of the cycle, the shuttle assembly 54 and the saddle assembly 56 are disposed adjacent the magazine 50, with the two projections 168, 182 (FIG. 10) being disposed directly adjacent the openings 80. As the edge protector 64 is pushed out of the magazine 50, the ends of the legs 64A, 64B engage the projections 168, 182 respectively, thereby causing the retention clips 160, 162 to pivot outwardly until the leg ends engage the respective gripper surfaces 166, 180.

When the pusher blade 100 has completed its outward stroke, as shown by the phantom lines in FIG. 6, the edge protector 64 has been completely ejected from the magazine 50 and is retained securely by the clips 160, 162 within the saddle assembly 56. At this point, the pusher blade 100 is retracted by the upward stroke of the piston rod 92, to the position shown by solid lines (FIG. 6). This permits the stack of edge protectors 64 (FIG. 4) to descend within the magazine 50, thus lining up the next edge protector 64 with the openings 80 for the subsequent dispensing cycle.

In the meantime, or subsequently, and referring now to FIGS. 7–10, the saddle assembly rotates about the dowel pin 144 (FIG. 8) from the edge protector receiving position, shown by the phantom lines, to the edge protector delivery position, shown by solid lines. The upper arm 154 engages a vertical wall of tab 140, thus aligning the position of the bottom wall surface 152 for delivery to an edge of a package 12 (FIG. 1). Activation of the rodless pneumatic cylinder 136 then transports the shuttle 120, including the saddle assembly 56 and the edge protector 64, toward the package edge by horizontally rolling the shuttle over the steel guide track 114 (FIGS. 7–9).

Monitoring and sensing equipment (not shown) recognize when the saddle assembly 56 has reached the edge of the package 12. This may occur by a tilting of the upper arm 154 to a vertical position when the arm surface 156 meets the vertical surface of the package 12, or by sensing when the retention clips 160, 162 are pushed back from the package bottom and vertical surfaces when the inner surface of the edge protector legs 64A, 64B are engaged.

In any event, when the edge protector 64 is projected onto the package edge and the system has sensed that this has occurred, the shuttle 120 ceases its horizontal rolling motion toward the package, and the retaining bar 58 (FIGS. 2 and 3) is hydraulically lifted above the level of the rollers 20 to engage the edge protector lower leg 64A, which causes the package contacting surface of the edge protector lower leg 64A to become flush with the bottom of the package. It should be understood that the ejection of the edge protector 64 from the magazine causes it to extend well beyond the edge of the clips 160, 162 see FIG. 11. The edge protectors are in effect held at one end by the clips 160, 162 leaving a substantial overhang for further manipulation by the retaining bar 58 and for receiving the strap. The retaining bar 58 thus impinges on the package non-contacting surface of the bottom leg 64A and the saddle assembly 56 impinges on the upper leg 64B so as to hold both of them flush against the bottom and vertical surfaces, respectively, of the package 12.

Once the bar has been raised and the edge protector 64 is retained firmly in place against the edge of package 12, the strapping sequence is activated causing a strap 43 (shown in phantom in FIG. 3) to be ejected by the strapping head and to be tightened around the package 12. The design of the inventive system, and especially the tight control of dimensional parameters, provides an advantage as can best be seen in FIGS. 2 and 3.

As has been described above and partially shown in FIG. 11, the edge protectors normally used are approximately 2½ inches wide and the gripper surfaces of the clips 160, 162 cover approximately 1 inch of that width at one side of the edge protector. The retaining bar 58 covers approximately ½ inch at the other side of the edge protector 64, thus leaving approximately a ½ to ¾ inch space between the saddle assembly 56 and the retaining bar 58 for the placement of the strap 43 centrally over the edge protector.

The spatial relationship of the shuttle and saddle assemblies 54, 56 and the retainer bar 58 on either side of the strap track 42 provides a precise guide for placement of the strap in the central location on the edge protector 64. Moreover, the present invention minimizes the bulk of the system, partially by providing dual functions to each of the assemblies. For example, the retaining bar 58 also serves as a straight edge guide for one lateral edge of the strap. For the other lateral edge of the strap, reference to FIG. 7 illustrates the offset placement of the shuttle intermediate portion 132, which also provides an edge guide for guiding the placement of the strap on the edge protector. The majority of components of the shuttle assembly 54 and of the saddle assembly 56 are to the left of the expected line of travel of the strap when it is undergoing the tightening process (FIG. 7). To promote proper placement of the strap and to provide assurance that the strap will clear the saddle assembly 56, the strap guide 157 is preferably included to guide the strap 43 to the right side of the saddle assembly 56 (FIGS. 3 and 11). As can be seen, the strap guide 157 is at an appropriate angle, such as 45°, relative to the vertical and can fulfill the function of guiding the strap toward the right (FIG. 11).

The combination and configuration of the elements shown in the detailed views provides a compact edge protector delivery and positioning system which can be utilized without taking up a great deal of space at a strapping station along a conveyor line. This invention thus provides the advantage of close placement of the several of the systems 10 in close proximity so that placement of several strapping machines may occur in a close packed space. Moreover, the compactness of the inventive system readily affords the opportunity to retrofit existing strapping machines, having established or existing roller configurations, with the inventive system without necessitating a breakdown of the conveyor roller configuration. Moreover, the inventive system is capable of receiving edge protectors having a wider range in the lengths of legs and in the included angle between those legs.

The preceding description and the drawings are by way of illustration only. It is to be understood that changes and variations to the inventive edge protector delivery and positioning system may be made without departing from the spirit and scope of the invention, which is only limited by the following claims and equivalents thereof.

What is claimed is:

1. Positioning apparatus for positioning and retaining an edge protector at an edge of a package to be looped with a strapping, the package being positioned on a package support and transported to an edge protector application station, each said edge protector having two elongated longitudinal side portions connected by a longitudinal fold, at least one package contacting surface and at least one package non-contacting surface, said edge protectors having a mean thickness, the apparatus comprising:

(a) an edge protector magazine spaced apart from the edge protector application station, the magazine, retaining stacked, nested edge protectors and including a magazine delivery station for systematically dispensing an individual edge protector on demand;

(b) a saddle shuttle assembly for transporting each individual edge protector from the magazine delivery station to the edge of the package, said saddle shuttle assembly including two resiliently mounted clips, each of said clips resiliently engaging an edge of an elongated longitudinal side portion of an edge protector for orienting and retaining each individual edge protector on said saddle shuttle assembly while it is being transported to said package edge, a retraction means for retracting said clips to disengage said edge protector after delivery to the package edge and before strapping, and a means for reciprocating the saddle shuttle assembly between the magazine delivery station and the edge of the package;

(c) a pusher for selectively driving an edge protector from said magazine delivery station onto said saddle shuttle assembly, said pusher including a pushing surface normal to the longitudinal fold of the edge protector and means to reciprocate said pusher between said magazine delivery station and said saddle shuttle assembly; and (d) retaining means disposed on said package support and being spaced apart from said saddle shuttle assembly for applying a substantially normal force to said at least one package non-contacting surface of said edge protector, said retaining means retaining said edge protector immediately adjacent said package edge so that the edge protector package contacting surface is in conforming relation to said package edge while the package is looped with a strapping.

2. A positioning apparatus according to claim 1 wherein said saddle shuttle assembly further includes a track for supporting the saddle shuttle assembly while it is being transported between said magazine delivery station and the package edge.

3. A positioning apparatus according to claim 1 wherein said package support comprises a package conveyor comprising plural rollers on which the package to be strapped is transported to a strapping location.

4. A positioning apparatus according to claim 1 wherein said edge protector magazine further comprises at least one vertically extending wall, a bottom wall member for supporting the stacked nested edge protectors at an inner surface thereof, and at least one stripper bracket attached to said respective vertically extending wall, each of said stripper brackets having a lower end defined by two edges, a substantailly vertically extending edge and an edge extending at an acute angle from a point of intersection with the substantially vertically extending edge, said point of intersection being at a predetermined distance from the inner surface of said magazine bottom wall member.

5. A positioning apparatus according to claim 4 wherein said predetermined distance between said intersection point of said stripper bracket equals approximately 1.75 times the mean thickness of said edge protectors.

6. A positioning apparatus according to claim 1 wherein said retaining means comprises a horizontal bar connected to said package support and being disposed immediately adjacent said edge protector application station, said bar being shaped and dimensioned to retractably extend from said package support and to engage said at least one non-contacting surface of said edge protector being retained by said bar.

7. A positioning apparatus according to claim 6 wherein said package support comprises a package conveyor comprising plural rollers on which the package to be strapped is transported to a strapping location and said horizontal bar extends from said package conveyor through a gap between a pair of adjacent rollers.

8. A method of protecting the edges of a package around which a strapping is to be strapped by use of an edge protector apparatus for each edge to be protected, comprising the steps of (a) providing a package support on which the package to be strapped is disposed, said package having at least one edge to be protected from damage by said strapping;

(b) providing in a stacked nested relationship a plurality of edge protectors within a magazine, at least one magazine being associated with each edge to be protected;

(c) dispensing a single edge protector from each said magazine through a magazine opening, said magazine opening having a predetermined size, shape and included angle to permit dispensing of only a single edge protector at a time, and dispensing said single edge protector to a saddle shuttle assembly associated with each said edge to be protected;

(d) resiliently engaging said single edge protector with resiliently mounted clips on said saddle shuttle assembly and shuttling said single edge protector by means of said saddle shuttle assembly from each said edge protector magazine to each said edge to be protected, wherein said edge protector is brought into contact with each said package edge to be protected and said resiliently mounted clips are retracted to disengage said edge protector.

(e) extending a retaining means from said package support to said edge of said package so that said edge protector is retained immediately adjacent said package edge; and (f) looping a strapping around said package and over each said edge, said retaining means and said saddle shuttle assembly providing a guide to said strapping during looping so that said strapping is positioned directly over said edge protector.

* * * * *